United States Patent [19]

Burris, II

[11] Patent Number: 4,457,377

[45] Date of Patent: Jul. 3, 1984

[54] SLIDING VALVE FLOAT COLLAR

[75] Inventor: Wesley J. Burris, II, Duncan, Okla.

[73] Assignee: Halliburton Company, Duncan, Okla.

[21] Appl. No.: 414,758

[22] Filed: Sep. 3, 1982

[51] Int. Cl.[3] ..... E21B 34/14

[52] U.S. Cl. ..... 166/332; 166/386

[58] Field of Search ..... 166/332–334, 166/285, 289, 386, 318, 327; 251/297, 339

[56] References Cited

U.S. PATENT DOCUMENTS

| | | | |
|---|---|---|---|
| 2,748,873 | 6/1956 | Baker et al. | 166/327 X |
| 3,051,243 | 8/1962 | Grimmer et al. | 166/332 |
| 3,273,650 | 9/1966 | Alexander et al. | 166/327 X |
| 3,948,322 | 4/1976 | Baker | 166/289 |
| 3,957,114 | 5/1978 | Streich | 166/285 |
| 4,133,386 | 1/1979 | Knox | 166/285 |
| 4,250,966 | 2/1981 | Streich et al. | 166/285 X |

*Primary Examiner*—James A. Leppink
*Assistant Examiner*—Thuy M. Bui
*Attorney, Agent, or Firm*—James R. Duzan; Thomas R. Weaver

[57] ABSTRACT

A float collar for use in inner string cementing operations for well casing where it is desired to open or close the float collar to control the fluids in the casing and on the exterior of the casing. The float collar comprises a float valve collar having a sliding type valve assembly located therein which is capable of being actuated as desired during the inner string well casing cementing operations.

13 Claims, 2 Drawing Figures

SLIDING VALVE FLOAT COLLAR

Background of the Invention

This invention relates to a sliding valve type float collar for inner string well cementing operations.

When utilizing thin walled casing in wells, it is desirable to allow fluid to fill the casing as it is being run into the well to prevent high differential fluid pressures from occurring across the wall of the casing and to allow the casing to be isolated to circulate out relatively light weight drilling fluids from the casing to be replaced with relatively heavy weight drilling fluid to prevent the casing from collapsing during well cementing operations from a high differential fluid pressure occurring across the wall of the casing due to heavy cementing being located on the outside of the casing and light weight drilling fluid being located in the interior of the casing.

To facilitate the filling of the thin walled casing and the circulation of drilling fluids therefrom, particularly during inner string cementing operations; i.e., operations where one string of well casing is being cemented inside another string of well casing, a well cementing tool, normally referred to as a float collar, is inserted into the casing string. After the completion of the cementing of the well casing in position, the float collar may either be left in place in the casing string or drilled out thereby requiring that the float collar be constructed of easily drillable materials that may be drilled by readily available rotary rock drilling bits.

Prior art inner string float collars do not meet these requirements because they are not designed to be opened or closed using mechanical bottom hole operating tools operated from the surface. Also, other prior art drillable downhole cementing tools which are designed to be opened and closed as desired cannot be used because they are not designed for use in inner string cementing operations for well casing.

Statement of the Invention

The present invention is directed to a float collar for use in inner string cementing operations for well casing where it is desired to open or close the float collar to control the fluids in the casing and on the exterior of the casing. The float collar of the present invention comprises a float valve collar having a sliding type valve assembly located therein which is capable of being actuated as desired during the inner string well casing cementing operations.

Brief Description of the Drawings

The advantages and operation of the present invention will be better understood when taken in conjunction with the following specification and drawings wherein.

Description of the Invention

Figure 1:
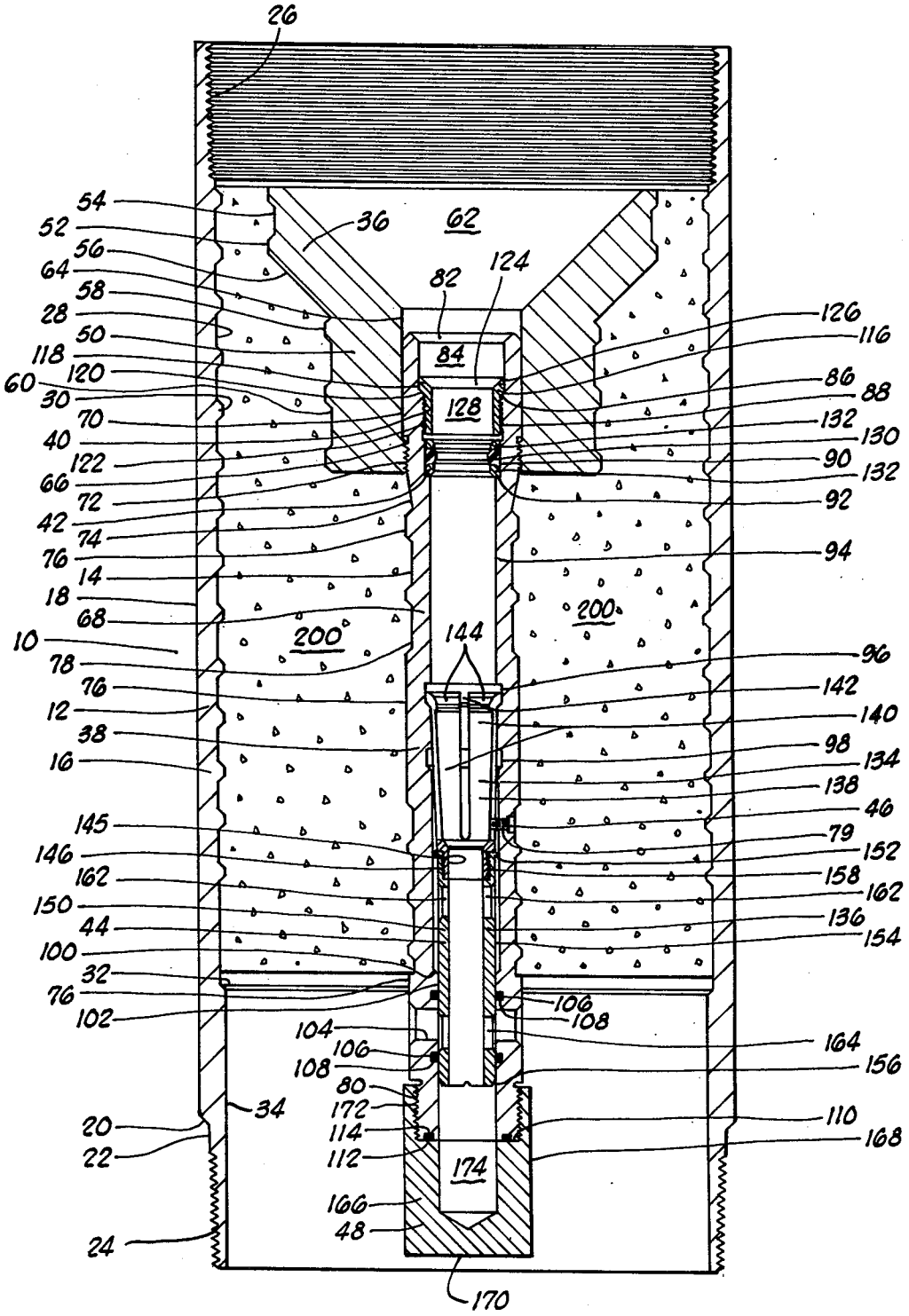
FIG. 1 is a cross-sectional view of the preferred embodiment of the present invention.

Referring to FIG. 1, the float collar 10 of the present invention is shown in its preferred embodiment. The float collar 10 of the present invention comprises a float valve collar 12 and sliding type valve assembly 14 located therein.

The float valve collar 12 comprises an annular cylindrical member 16 having, on the exterior, a first cylindrical exterior surface 18 extending from one end thereof to annular chamfered exterior surface 20, a second cylindrical exterior surface 22 and an exterior threaded portion 24 on the other end thereof and, on the interior, interior threaded portion 26 on one end of the member 16 opposite the exterior threaded portion 24, first cylindrical interior portion 28 of smaller diameter than that of interior threaded portion 26 having, in turn, a plurality of annular ribs 30 thereon, interior chamfered annular shoulder 32 and second cylindrical interior portion 34 of smaller diameter than first cylindrical interior portion 28.

The sliding type valve assembly 14 comprises guide member 36, valve mandrel 38, valve seal sleeve 40, valve seal 42, sliding valve member 44, valve alignment bolt 46 and valve cap 48.

The guide member 36 comprises an annular cylindrical member 50 having, on the exterior thereof, first cylindrical surface 52 having, in turn, annular recess 54 therein, frusto-conical annular surface 56 and second cylindrical surface 58 having, in turn, annular recesses 60 therein and, on the interior thereof, frusto-conical annular guide surface 62, cylindrical surface portion 64 at the termination of the smaller portion of surface 62 and interior threaded surface portion 66.

The valve mandrel 38 comprises an elongated annular cylindrical member 68 having, on the exterior thereof, first cylindrical surface portion 70, first threaded exterior surface portion 72 which threadedly engages interior threaded surface portion 66 of guide member 36 when installed therein, frusto-conical annular surface portion 74, second cylindrical surface portion 76 having, in turn, a plurality of annular recesses 78 therein and threaded aperture 79 therein extending through the wall of the valve mandrel 38 to the interior thereof and second threaded exterior surface portion 80 and, on the interior thereof, first interior annular chamfered surface portion 82, first interior cylindrical surface portion 84, second interior annular chamfered surface portion 86, threaded interior surface portion 88, second interior cylindrical surface portion 90, annular shoulder 92, third cylindrical interior surface portion 94 having, in turn, first 96 and second 98 annular recesses therein, third interior annular chamfered surface portion 100, and fourth cylindrical interior surface portion 102 having, in turn, a plurality of apertures 104 therein extending through the wall of the valve mandrel 38 terminating in a portion second cylidrical surface 76 and a plurality of annular recesses 106 therein containing elastomeric seal means 108. The lower end surface 110 of the valve mandrel 38 has an annular recess 112 therein having, in turn, elastomeric seal means 114 located therein.

The valve seal sleeve 40 comprises an annular cylindrical member 116 having, on the exterior thereof, cylindrical exterior surface portion 118, annular chamfered exterior surface portion 120 which abuts second interior annular chamfered surface 86 of valve mandrel 38 and threaded exterior surface portion 122 which threadedly engages threaded interior portion 88 of the valve mandrel 38 when the valve seal sleeve 40 is installed therein, and, on the interior thereof, annular chamfered interior surface portion 124 having, in turn, a plurality of recesses 126 therein and cylindrical interior surface portion 128.

The valve seal 42 comprises an annular elastomeric sealing portion 130 having annular metallic end portions 132 secured thereto. The valve seal 42 is sealingly retained within second interior cylindrical portion 90 of valve mandrel 38 being prevented from movement in one direction within the valve mandrel 38 by abutment with annular shoulder 92 while movement within the valve mandrel 38 in the other direction is prevented by engagement with valve seal sleeve 40.

The sliding valve member 44 comprises a collet portion 134 and valve portion 136. The collet portion 134 comprises an elongated annular cylindrical member 139 having a plurality of resilient spring fingers 140 on one end thereof separated by spaces 142 therebetween having, in turn, enlarged heads 144 on one end thereof which are resiliently biased in annular recesses 96 and 98 of valve mandrel 38, on the other end portion 145 thereof a threaded exterior surface portion 146 and bore 148 which extends through the resilient spring fingers 140 and other end portion 145. The valve portion 136 comprises air elongated annular cylindrical member 150 having, on the exterior thereof, first annular chamfered surface portion 152 which mates with third interior annular chamfered surface portion 100 of valve mandrel 38 to limit movement of the sliding valve member 44 within valve mandrel 38 in one direction, cylindrical exterior surface portion 154 which sealingly engages elastomeric seal means 108 in fourth cylindrical interior surface portion 102 of valve mandrel 38 and second annular chamfered surface portion 156 and, on the interior thereof, threaded interior surface portion 158 which threadedly engages threaded exterior surface portion 146 of collet portion 134 when installed thereon and cylindrical interior surface portion 160 having, in turn, a plurality of first 162 and second 164 of apertures extending through the wall of the valve portion 136 to the exterior thereof. The plurality of first 162 and second 164 of apertures are located in the valve portion 136 such that they are in an aligned relationship.

When the sliding valve member 44 is installed within the valve mandrel 38, the plurality of first 162 and second 164 of apertures in the member 44 are in an aligned relationship with the apertures 104 in the valve mandrel 38 so that when the member 44 is moved axially within mandrel 38, the plurality of first 162 and second 164 apertures will be intermittently aligned with the apertures 104. When the sliding valve member 44 is installed within valve mandrel 38, to maintain the plurality of first 162 and second 164 apertures in the member 44 in alignment with apertures 104 in the valve mandrel 38, a threaded valve alignment bolt 46 is installed in threaded aperture 79 of valve mandrel 38 having a portion of the threaded valve alignment bolt 46 extending into one of the spaces 142 located between the plurality of spring fingers 140 of the sliding valve member 44.

If desired, the sliding valve member 44 may be formed as a single member rather than as two separate members.

The valve cap 48 comprises a cylindrical member 166 having, on the exterior thereof, cylindrical exterior surface portion 168 and end surface portion 170 and, on the interior, threaded interior surface portion 172 which threadedly engages second threaded exterior surface portion 80 of valve mandrel 38 and cylindrical blind bore 174 which is of approximately the same diameter as fourth cylindrical interior surface portion 102 of valve mandrel 38 to allow sliding valve member 44 to extend thereinto during portions of actuation thereof.

To secure the sliding type valve assembly 14 within the float valve collar 12 with the upper end of the assembly 14 located slightly below the threaded interior threaded portion 26 and the lower end of assembly 14 located within the collar 12 a cementitious material 200 is used to fill the void between the valve assembly 14 and collar 12 such that the cementitious material fills the interior portion 28 of the collar 12 securely bonding to the annular ribs 30 thereon and securely bonding to the exterior of guide member 36 and the second cylindrical surface 76 having recesses 78 therein of valve mandrel 38. Any suitable type of cementitious material 200 may be utilized, although a cementitious material which is easily drillable by a readily available rotary rock drilling bit is preferred.

Figure 2:
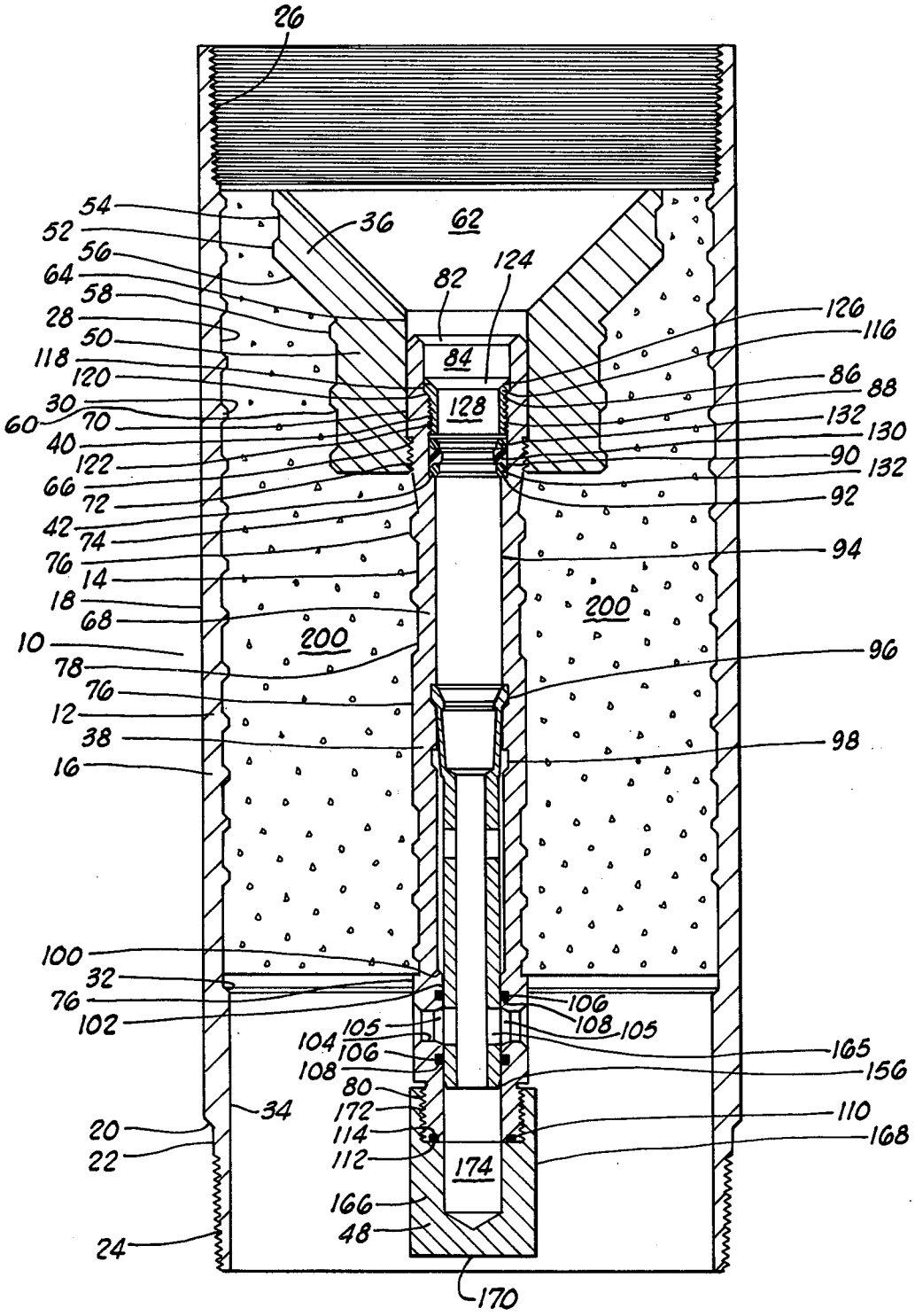
FIG. 2 is a cross-sectional view of an alternative embodiment of the present invention.

Referring to FIG. 2, an alternative embodiment of the present invention is shown. As shown in FIG. 2, the valve mandrel 38' is constructed similarly to that of the valve mandrel 38 shown in FIG. 1 except that threaded aperture 79 has been eliminated and an annular chamfered groove 105 connects the apertures 104 extending through the wall of valve mandrel 38.

The sliding valve member 44' shown in FIG. 2 is constructed similarly to the sliding valve member 44 shown in FIG. 1 except the member 44' has been formed as a single member rather than as two separate members as in the member 44.

By forming the valve mandrel 38' having an annular chamfered groove 105 connecting apertures 104 extending through the wall of the mandrel 38' it is unnecessary to have the apertures 162 or 164 of the sliding valve member 44' aligned with apertures 104 for fluid flow through the apertures 162 or 164 and 104 but rather fluid flow can occur through either apertures 162 or 164, through annular chamfered groove 105 and through apertures 104. In this manner the valve alignment bolt 46 and threaded aperture 79 may be deleted.

It should be noted that the sliding type valve assembly depicted in either FIG. 1 or FIG. 2 is constructed of materials which are easily drillable by a readily available rotary rock drilling bit.

Operation of Float Collar

Referring to either FIG. 1 or FIG. 2, in use, the float collar 10 is assembled into a casing string to be cemented into a well. To actuate the valve assembly 14 located in the float collar 10 a tool, such as a load transfer device of the type having Part No. 802.35847 which is available from Halliburton Services, a Division of Halliburton Company, is lowered through the casing string having the float collar 10 therein until it engages the sliding valve member 44 and also sealingly engages valve seal 42. When the sliding valve member 44 is moved downwardly in the float collar 10, the enlarged heads 144 on collet portion 134 of member 44 are cammed inwardly to disengage annular recess 96 of valve mandrel 38 and engage an annular recess on the actuating tool thereby moving the member 44 from its first or initial position within the float collar 10. Upon reaching annular recess 98 of the valve mandrel 38, due to the resilient spring fingers 140, the enlarged heads 144 on collet portion 134 spring outwardly to engage the recess 98 thereby maintaining sliding valve member 44 in the valve mandrel 38 in a second position therein unless further force is applied to the member 44. Further downward movement of the sliding valve member 44 in the valve mandrel 38 will cause the enlarged heads 144 of collet portion 134 to disengage annular recess 98 and slide along third cylindrical interior portion 94 of valve mandrel 38 until the valve member 44 has one end thereof abutting valve mandrel 38 thereby limiting downward movement of the valve member 44 within valve mandrel 38 thereby maintaining the member 44 in a third position within the float collar 10.

When the sliding valve member 44 is in a first position within the valve mandrel 38 having the enlarged heads 144 of collet portion 134 engaging annular recess 96 of mandrel 38, the apertures 164 in the valve member 44 are generally aligned with apertures 104 in valve memberel 38 thereby placing the interior of valve member 44 in communication with the exterior of the portion of the valve mandrel 38 extending beyond the bottom of the cementitious material 200. When the sliding valve member 44 is in a second position within the valve mandrel 38 having the enlarged heads 144 of the collet portion 134 engaging annular recess 98 of the mandrel 38, the portion of the valve member 44 extending between apertures 162 and 164 covers the apertures 104 in valve mandrel 38 thereby preventing communication between the interior of valve mandrel 38 and the exterior of the portion of the valve mandrel 38 extending beyond the bottom of the cementitious material 200. When the sliding valve member 44 is in a third position within the valve mandrel 38 having the enlarged heads 144 of the collet portion 134 disengaged from annular recess 98 having one end of valve member 44 abutting valve cap 48 apertures 162 in the valve member 44 are generally aligned with apertures 104 in valve mandrel 38 placing the interior of valve member 44 in communication with the exterior of the portion of the valve mandrel 38 extending beyond the bottom of the cementitious material 200. In this manner, the sliding valve member 44 is initially in open position within the valve mandrel 38 when in the first position, then a closed position when in the second position 38, and finally to another open position when in the third position.

It should be noted that since the sliding valve member 44 is a pressure balanced sliding valve; i.e., the seals 106 being the same sealing diameter to balance axial pressure forces acting on the valve member 44, the valve member 44 will remain in any of the first, second or third positions during fluid pressure fluctuations acting on the valve member 44.

By utilizing a sliding sleeve valve 44 in the float collar 10 and the appropriate actuating tool the valve 44 may be repeatedly opened and closed, as desired, during well cementing operations to control the flow of fluids therethrough thereby facilitating well cementing operations.

Having thus described my invention, I claim:

1. A float collar for use in cementing operations in wells comprising:
- a float collar comprising:
- an annular cylindrical member having a threaded portion on one end on the exterior thereof and a threaded
- portion on the other end on the interior thereof; and
- a sliding type valve assembly contained within the float collar comprising:
  - a guide member comprising:
    - an annular cylindrical member having, on the exterior thereof,
    - a first cylindrical surface,
    - a frusto-conical annular surface, and, on the interior thereof,
    - a frusto-conical annular guide surface,
    - a cylindrical surface, and
    - a threaded surface;
  - a valve mandrel including a part therein and having one end thereof secured
  - to the guide member;
  - a valve seal sleeve located within the valve mandrel;
  - a sliding valve member located within the valve mandrel for opening and closing said part; and
  - a cap secured to the other end of the valve mandrel.

2. The float collar of claim 1 wherein the sliding type valve assembly means further comprises:
- valve alignment bolt means.

3. The float collar of claim 1 wherein the float collar further comprises:
- cementitious material securing said sliding type valve assembly means to the float collar means.

4. The float collar of claim 1 wherein the valve mandrel comprises:
- an elongated annular cylindrical member having, on the exterior thereof;
  - first cylindrical surface portion,
  - first threaded exterior surface portion,
  - frusto-conical annular surface portion,
  - second cylindrical surface portion having a plurality
- of annular recesses therein, and
  - second threaded exterior surface portion; and on the interior thereof;
  - first interior annular chamfered surface portion,
  - first interior cylindrical surface portion,
  - second interior annular chamfered surface portion,
  - threaded interior surface portion,
  - second interior cylindrical portion,
  - third cylindrical interior surface portion having first and second annular recesses therein,
  - third interior annular chamfered surface portion,
- and
  - fourth cylindrical interior surface portion having a plurality of apertures therein extending through the wall of the elongated annular cylindrical member of the valve mandrel means and a plurality of annular recesses each having in turn therein an elastomeric seal.

5. The float collar of claim 4 wherein the valve mandrel further comprises:
- a threaded aperture located in the second cylindrical surface portion of the exterior of the elongated annular cylindrical member extending through the wall thereof.

6. The float collar of claim 4 wherein the valve mandrel further comprises:
- an annular chamfered groove connecting the plurality of apertures in the fourth cylindrical surface portion on the interior of the elongated annular cylindrical member of the valve mandrel.

7. The float collar of claim 4 wherein the valve seal sleeve comprises:
- an annular cylindrical member having, on the exterior thereof;
  - a cylindrical exterior surface portion,
  - an annular chamfered exterior surface portion, and
  - threaded exterior surface portion; and on the interior thereof;
  - an annular chamfered interior surface portion having a plurality of recesses therein, and
  - a cylindrical interior surface portion.

8. The float collar of claim 11 wherein the sliding valve member comprises:

an elongated annular cylindrical member having a plurality of resilient spring fingers on one end thereof, each spring finger means having, in turn, an enlarged head on one end thereof, having, on the exterior thereof, a first annular chamfered shoulder portion, a cylindrical exterior surface portion and a second annular chamfered surface portion, and, on the interior thereof, a bore through the plurality of resilient spring fingers and a cylindrical interior surface portion having a plurality of first and second apertures extending through the wall of the elongated annular cylindrical member.

9. The float collar of claim 7 wherein the valve seal comprises:

an annular elastomeric sealing portion having annular metallic end portions secured thereto.

10. The float collar of claim 11 wherein the cap comprises:

cylindrical member having, on the exterior thereof;
cylindrical exterior surface portion, and
end surface portion; and, on the interior thereof;
threaded interior surface portion, and
a cylindrical blind bore.

11. The float collar of claim 9 wherein the sliding valve member comprises:

collet portion; and
valve portion.

12. The float collar of claim 11 wherein the collet portion of the sliding valve member comprises:

an elongated annular cylindrical member having a plurality of resilient spring fingers on one end thereof, each spring finger having, in turn, an elongated head on one end thereof, each enlarged head having a threaded exterior surface portion on the other end thereof and having a bore therethrough.

13. The float collar of claim 12 wherein the valve portion of the sliding valve member comprises:

an elongated annular cylindrical member having, on the exterior thereof;
first annular chamfered shoulder portion,
cylindrical exterior surface portion, and
second annular chamfered surface portion; and, on the interior thereof;
threaded interior surface portion, and
cylindrical interior surface portion having a plurality of first and second apertures extending through the wall of the elongated annular cylindrical member.

* * * * *

UNITED STATES PATENT AND TRADEMARK OFFICE

CERTIFICATE OF CORRECTION

PATENT NO. : 4,457,377

DATED : Jul. 3, 1984

INVENTOR(S) : Wesley J. Burris, II

It is certified that error appears in the above-identified patent and that said Letters Patent is hereby corrected as shown below:

In column 3, line 12, delete the numeral [139] and insert therefor --138--.
In column 3, line 21, delete the word [air] and insert therefor --an--.
In column 5, end of line 11 and beginning of line 12, delete the word [memberel] and insert therefor --mandrel--.
In column 6, lines 2 and 8, delete the word [part] and insert therefor --port--.

Signed and Sealed this

*Twenty-seventh* Day of *November 1984*

[SEAL]

*Attest:*

GERALD J. MOSSINGHOFF

*Attesting Officer*

*Commissioner of Patents and Trademarks*